United States Patent [19]

Komaniak

[11] Patent Number: 4,746,776

[45] Date of Patent: May 24, 1988

[54] FLOAT-ACTUATED SWITCHING ASSEMBLY

[75] Inventor: Garrett A. Komaniak, Benton Harbor, Mich.

[73] Assignee: Webster Electric Company, Inc., Racine, Wis.

[21] Appl. No.: 76,218

[22] Filed: Jul. 22, 1987

[51] Int. Cl.[4] ..... H01H 35/18

[52] U.S. Cl. ..... 200/84 R; 200/84 C; 340/625; 73/317

[58] Field of Search ..... 335/205, 206, 207, 305, 335/306; 340/623, 625; 73/308, 313, 315, 317; 307/118; 200/61.2, 308, 84 R, 84 C

[56] References Cited

U.S. PATENT DOCUMENTS 3,480,749 11/1969 Greutman ..... 200/84 R
3,944,844 3/1976 Innes ..... 200/84 C
4,038,507 7/1977 Murphy, Jr. ..... 200/84 R
4,144,757 3/1979 Mauboussin ..... 200/84 R

*Primary Examiner*—G. P. Tolin
*Attorney, Agent, or Firm*—Peter N. Jansson, Ltd.

[57] ABSTRACT

An improved float-actuated switching assembly, having a pusher (92) linked to a float (14), a movable carrier member (16), preferably a pivotable cam, having upper and lower brackets (78 and 80) between which the pusher moves, first and second stops (18 and 20) to limit carrier movement, a contact member (22) on the carrier positioned to contact the stops, and magnets (88 and 90) to releasably hold the contact against a stop as the pusher moves toward and applies initial force to one of the brackets. Increasing force caused by continuing float movement eventually breaks the magnetic force such that the carrier moves quickly to actuate a switch element (26) preferably through a cam follower (96).

19 Claims, 2 Drawing Sheets

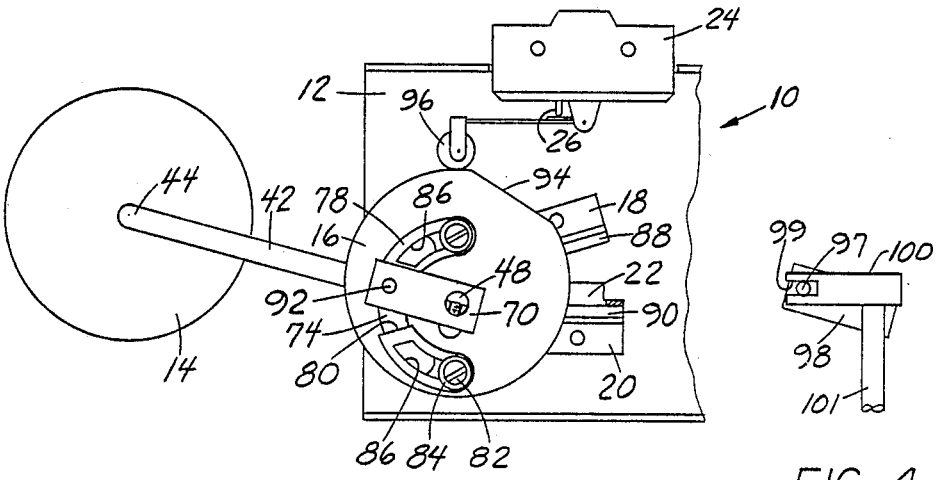
FIG. 1
FIG. 4
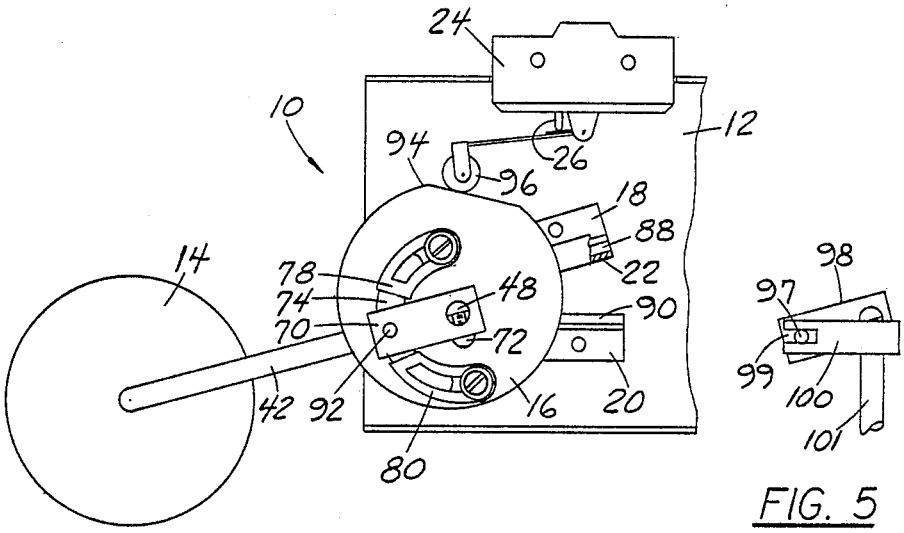
FIG. 2
FIG. 5

FLOAT-ACTUATED SWITCHING ASSEMBLY

FIELD OF THE INVENTION

This invention is related generally to electrical switches and, more particularly, to electrical switches actuated by change in a liquid level.

BACKGROUND OF THE INVENTION

Many different switching devices operate in response to changes in the level of a contained liquid. One general type of such switching devices each include a switch element movable between off and on positions, a float and means to link the float and the switch element. Many different float-actuated switches of this general type have been developed.

Certain float-actuated switches of the prior art have problems and deficiencies. Some include springs and other elements which are particularly susceptible to wear of the kind which can eventually impair switch operation. Some are also particularly complex in construction and operation.

In operation, some float-actuated switches have an indistinct switching action which may cause at least temporary wavering between off and on positions as the liquid level changes slowly. Various improvements have been made using magnets in an effort to improve the switching operation.

Among the float-actuated switches of the prior art are those disclosed in the following U.S. Pat. Nos.

2,945,102 (Smith)
4,335,285 (West)
4,191,951 (Fuzzell)
2,671,834 (Kimiecik)
4,404,441 (MacLaren)

Despite the continuing efforts to improve float-actuated switches, there remains a need for an improved float-actuated switching assembly which is simple in construction, less prone to develop problems due to wear and tear, and yet is distinct in its switching action, eliminating any wavering between the off and on positions of the switch.

OBJECTS OF THE INVENTION

It is an object of this invention to provide an improved float-actuated switching assembly overcoming some of the problems and shortcomings of the prior art.

Another object of this invention is to provide a float-actuated switching assembly which is durable and less susceptible to wear-ralated problems.

Another object of this invention is to provide a float-actuated switching assembly which is simple in construction and operation.

Another object of this invention is to provide a float-actuated switching assembly which has improved distinctness in its switching action.

Another object of this invention is to provide a float-actuated switching assembly which has improved distinctness in its switching action, yet is simple and durable in construction.

These and other important objects will be apparent from the descriptions of this invention which follow.

SUMMARY OF THE INVENTION

This invention is an improved float-actuated switching assembly of the type having a switch element, a float and means to link the float and the switch element. The switching assembly of this invention includes a principal or base member to which the various functional parts are secured. Such base is secured to a reservoir in which the float is free to rise and fall in response to the rising and falling of the liquid level.

Attached to the base are a switch element, a carrier member movably secured to the base and linked to the switch element to move it between off and on positions, and means adjacent to the carrier to limit carrier movement between first and second positions. The carrier has upper and lower brackets affixed to it, preferably in an adjustable manner. The switching assembly also includes a pusher element rigidly linked with respect to the float and movable between the brackets as the float moves. The brackets define the ends of a path of pusher movement with respect to the carrier.

The pusher exerts the force of the float on the carrier member through one of the brackets, causing the carrier member to move. However, the limit means, which are preferably secured to the base adjacent to the carrier, form first and second stops limiting carrier movement. Affixed to the carrier is a means to contact the stops to block carrier movement beyond certain positions.

An important part of this invention is means to releasably hold such contact means, which is affixed to the carrier, against one of the stops as the pusher moves toward and applies initial force to one of the brackets. Such holding means is preferably a magnet. When the pusher applies sufficient force to such bracket, the holding means is released such that the carrier moves quickly to actuate the switch, eliminating any concern about indistinctness in the switching operation.

All preferred embodiments include two releasable holding means, preferably two magnets, each holding the contact means against one of the stops as the pusher moves toward and applies initial force to one of the brackets. More specifically, one magnet holds the contact means against one of the stops as the pusher moves toward and applies initial force to one of the brackets, and another magnet holds the contact means against the other stop as the pusher moves toward and applies initial force to the other bracket.

Changes in the liquid level are typically rather gradual. However, the structure of this invention allows accumulation of force, which is generated either by the increasing buoyancy of the float when the liquid is rising around it or by the weight of the float when the liquid is falling, to create the distinct movement necessary for proper operation of the switch. As a result, gradual movements are not applied to the switch element. Only distinct actuating movements are applied, and that occurs after the magnetic force between contact means and stop has been broken by pusher pressure on a bracket.

The stops which are part of the means to limit carrier movement are preferably opposed stop surfaces, each of the magnets being secured at one of the stop surfaces. The contact member is preferably a single member movable between such opposed stop surfaces. The single member includes a magnetically attracted material such as steel.

The movable carrier member preferably forms a slot and the pusher extends through the slot. The slot forms a controlled path for pusher movement between the brackets.

The brackets are preferably positioned to ajustably limit the effective length of the slot. Adjustment of the effective length of the slot limits the extent of pusher movement and float movement which will occur prior to the breaking of the magnetic engagement of the contact means and the stops. Proper adjustment of the effective slot length will depend on the extent of expected liquid level variation, the strength of the magnets, and, of course, the specific configuration of an embodiment of this invention.

In an highly preferred form of this invention, the main or base member, to which various other parts of the device are secured, defines a pivot axis. The carrier member is a cam which is pivotable about the axis and has a camming surface variably spaced therealong from the axis. Such preferred embodiments include a follower on the camming surface which is connected to the switch element to move it between off and on positions as the cam pivots. The cam will only pivot as the aforementioned magnetic engagement is broken.

In such preferred embodiments, the cam preferably forms a slot which extends along an arc centered on the axis. Such embodiments preferably also include a float arm having the float at one end and an opposite end pivotably mounted with respect to both the base and the cam for pivoting about the axis. The pusher is preferably located within the slot and rigidly fixed with respect to the float arm at a position spaced from the axis. Such pusher positioning is preferably between the ends of the float arm.

Such embodiments preferably also include an axial pivot member to which the float arm is affixed for pivoting about the axis A lever arm preferably is also affixed to the axial pivot member, with the pusher being affixed to such lever arm. The float arm and the lever arm are preferably on opposite sides of a sealed mounting aperture in the base.

The float-actuated switching assembly of this invention requires no springs or other parts which are particularly susceptible to wear. And, the switching assembly of this invention is simple in construction and operation.

BRIEF DESCRIPTION OF THE DRAWINGS

FIG. 1 is a side elevation of a preferred embodiment of this invention.

FIG. 2 is a similar side elevation which shows portions of the switching assembly in a different operational position.

FIGS. 4 and 5 are fragmentary elevations of an alternate embodiment of this invention in operational positions comparable to FIGS. 1 and 2, respectively.

DETAILED DESCRIPTIONS OF PREFERRED EMBODIMENTS

Figure 3:
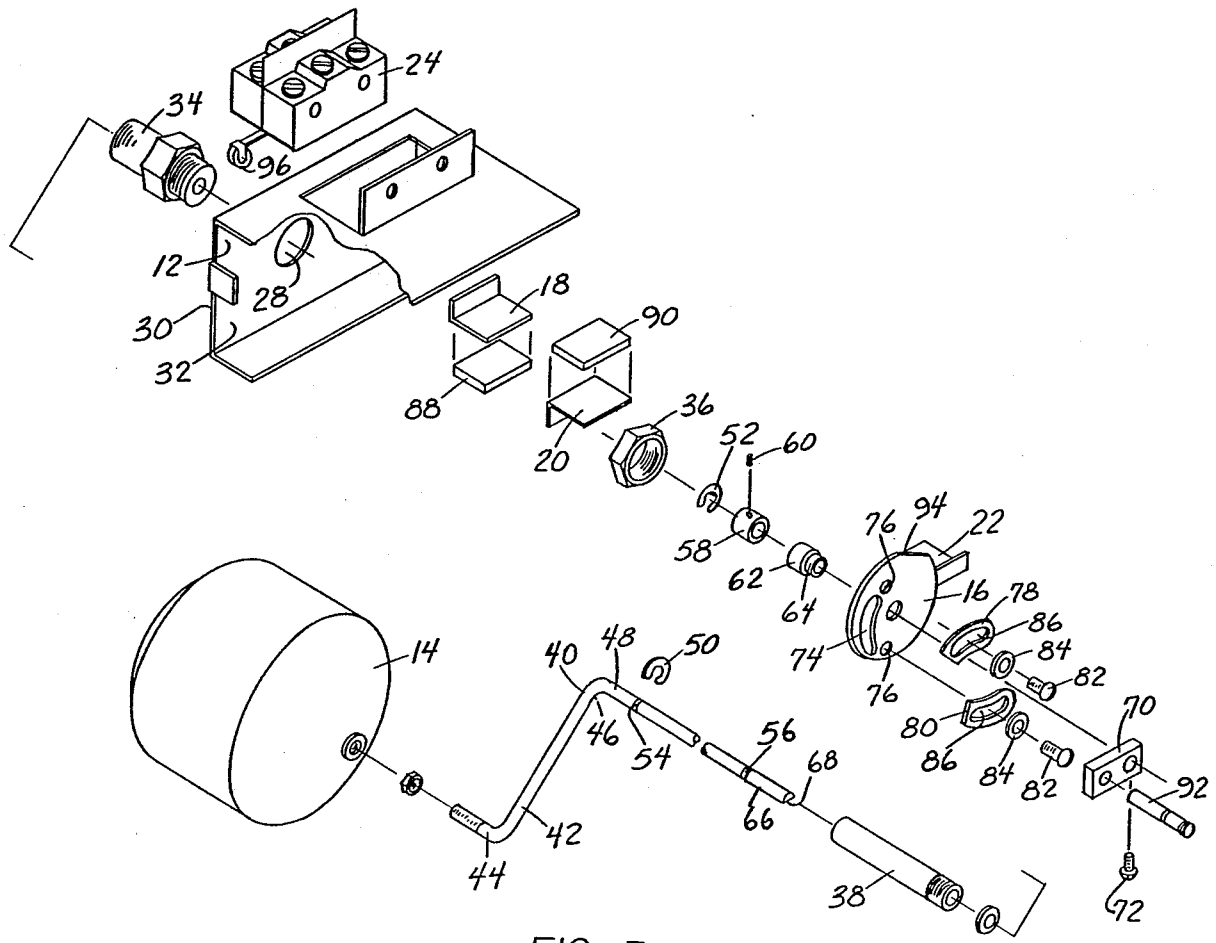
FIG. 3 is an exploded perspective view.

FIGS. 1–3 illustrate a float-actuated switching assembly 10 in accordance with a preferred embodiment of this invention. Switching assembly 10 has a principal mounting member or base 12 to which the other elements of switching assembly 10 are secured. These include a float 14, a cam 16, upper and lower limit members 18 and 20, a contact member 22, and a switch 24 which has a switch element 26 movable between off and on positions.

Base 12 is mountable in the side of a tank containing a liquid the level of which controls switch 24. As shown in FIG. 3, base 12 has an aperture 28 which defines a horizontal main pivot axis about which cam 16 and float 14 pivot. Such axis is frequently referred to in this description and is a principal reference point and line.

Aperture 28 is in a wall which has a first side 30 exposed to liquid in the tank and a second side 32 away from liquid exposure. A fitting 34 is mounted about aperture 28 by means of a hex nut 36. Received within fitting 34 is an extension tube 38 which provides an axial pivot bearing for the mounting of a float-supporting member 40.

Float-supporting member 40 includes a portion, referred to as float arm 42, which is the effective radius of pivoting of float 14 with respect to the main pivot axis. Float arm 42 has a first end 44 to which float 14 is attached by means of threaded engagement, as shown in FIG. 3. At a second or opposite end 46 of float arm 42, and forming another part of float-supporting member 40, is an axial pivot member 48 which extends through fitting 34, extension tube 38, aperture 28 and nut 36, from first side 30 to second side 32.

Axial pivot member 48 is held in proper axial position by means of snap rings 50 and 52 which engage it at grooves 54 and 56, respectively. A collar 58 is secured to axial pivot member 48 by means of a set screw 60. A bushing 62 is rotatably mounted on axial pivot member 48 adjacent to collar 58. Bushing 62 has a reduced diameter portion 64 on which cam 16 is rotatably mounted.

Axial pivot member 48 has a terminal portion 66 which extends through and beyond cam 16. Terminal portion 66 has a flat side 68 on which a lever 70 is mounted. Lever 70 is affixed to terminal portion 66 of axial pivot member 48 by means of a screw 72 which extends through lever 70 to engage flat side 68. Thus, both float arm 42 and lever 70 are rigidly secured with respect to axial pivot member 48. Float arm 42 and lever arm 70 move as one when float 14 rises and falls. Lever 70 is generally parallel to float arm 42.

Cam 16 forms an arcuate slot 74 extending along an arc which is centered on the aforementioned horizontal main axis, that is, the axis along which axial pivot member 48 extends. As shown best in FIG. 3, a pair of threaded orifices 76 are located just off the ends of slot 44 and are used for securing an upper bracket 78 and a lower bracket 80 to cam 16.

Upper and lower brackets 78 and 80 are adjustably affixed to cam 16 by means of screws 82 which extend through washers 84 and elongated openings 86 in brackets 78 and 80 into orifices 76. Portions of upper and lower brackets 78 and 80 extend over arcuate slot 74 and serve to define and limit the effective length of slot 74, as hereafter explained.

Contact member 22 is affixed to cam 16 at a peripheral position on the side of cam 16 which faces base 12. Contact member 22 moves with cam 16 as it rotates about the main pivot axis. Contact member 22 moves between upper and lower limit members 18 and 20 which are affixed to base 12. Upper and lower limit members 18 and 20, through their engagement with contact member 22, limit the extent of rotational movement of cam 16.

Secured as important portions of upper and lower limit members 18 and 20 are first and second magnets 88 and 90, respectively. The surfaces of magnets 88 and 90 which face contact member 22 are referred to herein as first and second stops, respectively. Contact member 22, which is made of steel or another magnetically-attracted material, is attracted to and held on magnets 88 and 90 when in proximity to them or in contact with them.

Thus, when contact member 22 is in contact with one of the magnets 88 and 90, such magnet releasably holds contact member 22 against it. This prevents free rotation of cam 16. Indeed, rotation of cam 16 will only occur once the magnetic engagement of the magnet with contact member 22 is broken. More than an initial amount of rotational force must be applied to rotate cam 16.

Rotational force is applied to cam 16 by means of a pusher 92 which is affixed to lever 70 and extends from lever 70 into slot 74 in cam 16. By virtue of being affixed to lever 70, pusher 92 is rigidly fixed with respect to float 14. The radial position of pusher 92 is between first and second ends 44 and 46 of float arm 42.

As float 14 rises and falls, pusher 92 moves between upper and lower brackets 78 and 80. After contacting one of such brackets, pusher 92 applies force to it as the liquid level continues to change.

As the liquid level continues to rise after contact of pusher 92 with upper bracket 78, the liquid will rise with respect to float 14 such that the buoyancy of float 14 causes an increasing upward force of pusher 92 on upper bracket 78. Likewise, after the liquid level falls to the extent that pusher 92 contacts lower bracket 80, further falling causes the liquid level to fall with respect to float 14 such that the weight of float 14 is increasingly applied through pusher 92 on lower bracket 80.

In either case, when a sufficient force is applied, the magnetic engagement of contact member 22 with either magnet 88 or 90 is broken. This causes contact member 22 to move quickly toward the other magnet which causes a quick pivoting motion of cam 16. The magnetic attraction applied to contact member 22 by the magnet which it is approaching accelerates and makes still more definite the rotational motion of cam 16.

Cam 16 is an irregularly shaped and eccentrically mounted member. Cam 16 has a camming surface 94 which is variably spaced from the pivot axis at different positions therealong, as most clearly shown in FIGS. 1 and 2. A follower 96 rests on camming surface 94 and is connected to movable switch element 26 by bearing against it.

In the position illustrated in FIG. 1, cam 16 has previously completed a clockwise move which caused contact member 22 to engage lower limit member 20. This previous movement quickly moved follower 96 to the raised position shown in FIG. 1, in which it depressed movable switch element 26. Switch element 26 remains fully depressed as the liquid level falls, as is occurring in FIG. 1. As it falls the liquid level gradually carries float 14 downwardly which gradually moves pusher 92 toward lower bracket 80. During this movement, cam 16 does not rotate.

Eventually, float 14 and pusher 14 fall to the extent that pusher 14 contacts and then applies increasing pressure on lower bracket 80. As explained, this finally causes contact member 22 to break away from magnet 90, which results in a quick counterclockwise motion of cam 16 to the cam position shown in FIG. 2.

FIG. 2 illustrates the upward movement of float 14 and pusher 92 as the liquid level rises. As the liquid level rises, pusher 92 approaches upper bracket 78. After pusher 92 contacts and then applies increasing pressure on upper bracket 78, contact member 22 will eventually break away from magnet 88, causing quick clockwise motion of cam 16 to the cam position shown in FIG. 1.

The embodiment illustrated in FIGS. 1–3 is a side-mounted version of the invention. FIGS. 4 and 5 schematically illustrate a top-mounted version of the invention.

In FIGS. 4 and 5, the float is located directly below the switching assembly. A pusher 97 attached to a lever 98 engages a slot 99 in a top member member 100 which in turn is affixed to a vertical rod the lower end of which supports a float (not shown). As the float rises and falls, its buoyancy or weight is transferred to lever 98 by means of pusher 97. Although not shown in FIGS. 4 and 5, a portion of pusher 97 extends into an arcuate slot and engages upper and lower brackets in the manner described with respect to FIGS. 1–3.

The float-actuated switching assemblies of this invention may be made using readily available materials and parts. Appropriate magnets would be apparent to those skilled in the art who are made familiar with this invention. Likewise, appropriate adjustments of the length of the slot 74 and the lengths of float arm 42 and lever 70, as well as other dimensions, would be apparent to those skilled in the art and familiar with this invention. Follower 96 can be specially arranged with an electrical switch. And, electric switches are available having such followers on them.

While adjustable brackets like upper and lower brackets 78 and 80 are preferred, adjustability is not essential. Indeed, the brackets may simply be the ends of a slot of fixed dimension or some other pressure point for a pusher element.

While the principles of this invention have been described in connection with specific embodiments, it should be understood clearly that these descriptions are made only by way of example and are not intended to limit the scope of the invention.

What is claimed:

1. In a float-actuated switching assembly of the type with a switch element, a float, and means to link the float and the switch element, the improvement comprising:

a base having the switch element secured on it;

a carrier movably secured to the base and linked to the switch element to move it between off and on positions;

upper and lower brackets on the carrier;

a pusher linked to the float and movable between the brackets as the float moves;

means adjacent to the carrier to limit carrier movement to between first and second positions, the limit means having first and second stops;

means on the carrier positioned to contact the stops to stop carrier movement;

means to releasably hold the contact means against one of the stops as the pusher moves toward and applies initial force to one of the brackets, whereby when sufficient force is applied the holding means is released such that the carrier moves quickly to actuate the switch.

2. The switching assembly of claim 1 wherein the holding means comprises a magnet.

3. The switching assembly of claim 1 further comprising another means to releasably hold the contact means against the other of the stops as the pusher moves toward and applies initial force to the other of the brackets, both holding means being magnets.

4. The switching assembly of claim 3 wherein:

the stops are separate members having opposed stop surfaces, each of the magnets being secured at one of the stop surfaces; and the contact means is a single member movable between such surfaces, the single member including a magnetically attracted material.

5. The switching assembly of claim 4 wherein:

the carrier forms a slot, the pusher extending therethrough; and the brackets are adjustable on the carrier and are positioned to limit the effective length of the slot.

6. In a float-actuated switching assembly of the type with a switch element, a float, and means to link the float and the switch element, the improvement comprising:

a base defining a pivot axis, the base having the switch element secured on it;

a cam pivotable about the axis and having a camming surface variably spaced therealong from the axis;

a follower on the camming surface connected to the switch element to move it between off and on positions as the cam pivots;

upper and lower brackets on the cam;

a pusher linked to the float and movable between the brackets as the float moves;

means on the base adjacent to the cam to limit cam pivoting to between first and second positions, the limit means having first and second stops;

means on the cam positioned to contact the stops to stop cam pivoting;

means to releasably hold the contact means against one of the stops as the pusher moves toward and applies initial force to one of the brackets, whereby when sufficient force is applied the holding means is released such that the cam pivots quickly to move the follower and actuate the switch.

7. The switching assembly of claim 6 wherein the holding means comprises a magnet.

8. The switching assembly of claim 6 further comprising another means to releasably hold the contact means against the other of the stops as the pusher moves toward and applies initial force to the other of the brackets.

9. The switching assembly of claim 8 wherein both holding means are magnets.

10. The switching assembly of claim 9 wherein the stops are separate members having opposed stop surfaces and the contact means is a single member movable between such surfaces.

11. The switching assembly of claim 10 wherein each of the magnets is secured at one of the stop surfaces and the single member includes a magnetically attracted material.

12. The switching assembly of claim 11 further comprising:

a float arm having the float at one end and an opposite end pivotably mounted with respect to the base and the cam about the axis; and the pusher rigidly fixed with respect to the float arm at a position spaced from the axis.

13. The switching assembly of claim 12 wherein the pusher is positioned between the ends of the float arm.

14. The switching assembly of claim 13 further comprising:

an axial pivot member to which the float arm is affixed for pivoting with respect to the base; and a lever arm affixed to the axial pivot member, the pusher being affixed to the lever arm.

15. The switching assembly of claim 11 wherein:

the cam forms a slot, the pusher extending therethrough; and the brackets are adjustable on the carrier and are positioned to limit the effective length of the slot.

16. The switching assembly of claim 15 wherein the slot is along an arc centered on the axis.

17. The switching assembly of claim 15 further comprising:

a float arm having the float at one end and an opposite end pivotably mounted with respect to the base and the cam about the axis; and the pusher within the slot and rigidly fixed with respect to the float arm at a position spaced from the axis.

18. The switching assembly of claim 17 wherein the pusher is positioned between the ends of the float arm.

19. The switching assembly of claim 18 further comprising:

an axial pivot member to which the float arm is affixed for pivoting with respect to the base; and a lever arm affixed to the axial pivot member, the pusher being affixed to the lever arm.

* * * * *